US008960961B2

(12) United States Patent
Chen

(10) Patent No.: US 8,960,961 B2
(45) Date of Patent: Feb. 24, 2015

(54) LAMPS WITH FUNCTIONS OF ADJUSTING ILLUMINATION DIRECTIONS

(75) Inventor: Fu-Shin Chen, Hsinchu (TW)

(73) Assignee: Lextar Electronics Corporation, Hsinchu (TW)

( * ) Notice: Subject to any disclaimer, the term of this patent is extended or adjusted under 35 U.S.C. 154(b) by 331 days.

(21) Appl. No.: 13/485,611

(22) Filed: May 31, 2012

(65) Prior Publication Data

US 2013/0170201 A1 Jul. 4, 2013

(30) Foreign Application Priority Data

Jan. 2, 2012 (TW) ..... 101100015 A

(51) Int. Cl.
*F21V 7/18* (2006.01)

(52) U.S. Cl.
USPC ..... 362/277; 362/280; 362/282

(58) Field of Classification Search
CPC ..... F21V 14/04; F21V 14/08; F21S 48/1778; F21S 48/145; F21S 48/1388; F21S 48/1757; F21S 4/008
USPC ..... 362/277, 278, 280–283, 296.01, 306
See application file for complete search history.

(56) References Cited

U.S. PATENT DOCUMENTS

| | | | | |
|---|---|---|---|---|
| 6,561,678 | B2 * | 5/2003 | Loughrey | 362/282 |
| 7,331,697 | B1 * | 2/2008 | Hulse | 362/551 |
| 2002/0105807 | A1 * | 8/2002 | Loughrey | 362/278 |
| 2005/0219849 | A1 * | 10/2005 | Kotovsky et al. | 362/321 |
| 2006/0012997 | A1 * | 1/2006 | Catalano et al. | 362/253 |
| 2009/0103293 | A1 * | 4/2009 | Harbers et al. | 362/231 |
| 2009/0296401 | A1 * | 12/2009 | Gutierrez, Jr. | 362/284 |
| 2011/0261576 | A1 * | 10/2011 | Uchida | 362/512 |
| 2013/0027958 | A1 * | 1/2013 | Okubo | 362/512 |

* cited by examiner

*Primary Examiner* — Nimeshkumar Patel
*Assistant Examiner* — Christopher Raabe

(57) ABSTRACT

A lamp with functions of adjusting an illumination direction is disclosed. A substrate is disposed on a base and includes a through groove. At least one light source is disposed on the substrate. An electronic control unit is disposed in the base. A telescopic member is disposed in the base and is connected to the electronic control unit. The electronic control unit drives the telescopic member to elongate and shorten. A flexible light guiding sheet is connected to the telescopic member. When the electronic control unit drives the telescopic member to elongate, the flexible light guiding sheet protrudes onto the substrate via the through groove of the substrate and deflects toward a specific direction, changing the illumination direction of the light source.

18 Claims, 6 Drawing Sheets

LAMPS WITH FUNCTIONS OF ADJUSTING ILLUMINATION DIRECTIONS

CROSS REFERENCE TO RELATED APPLICATIONS

This application claims priority of Taiwan Patent Application No. 101100015, filed on Jan. 2, 2012, the entirety of which is incorporated by reference herein.

BACKGROUND OF THE INVENTION

1. Field of the Invention

The invention relates to lamps, and more particularly to lamps with functions of arbitrarily adjusting illumination directions or angles according to practical illumination requirements.

2. Description of the Related Art

Conventional lamps are provided with only fixed or unidirectional illumination. Namely, an illumination direction or angle of the conventional lamps cannot be changed.

Referring to FIG. 1A and FIG. 1B, a conventional lamp 1 comprises a transparent tube 10, a base plate 20, a plurality of light sources 30, and a reflector 40.

The base plate 20 is disposed in the transparent tube 10.

The light sources 30 are disposed on the base plate 20.

The reflector 40 is connected to the transparent tube 10 and is disposed above the light sources 30.

Light from the light sources 30 is reflected by the reflector 40 disposed above the light sources 30 and is transmitted to the exterior of the lamp 1 through two opposite sides of the transparent tube 10. Nevertheless, as the reflector 40 is fixed, an illumination direction or angle provided by the lamp 1 is also fixed and thus cannot be adjusted.

Hence, there is a need for lamps with functions of arbitrarily adjusting illumination directions or angles as required.

BRIEF SUMMARY OF THE INVENTION

A detailed description is given in the following embodiments with reference to the accompanying drawings.

An exemplary embodiment of the invention provides a lamp with functions of adjusting an illumination direction, comprising a base, a substrate, at least one light source, an electronic control unit, a telescopic member, and a flexible light guiding sheet. The substrate is disposed on the base and comprises a through groove. The light source is disposed on the substrate. The electronic control unit is disposed in the base. The telescopic member is disposed in the base and is connected to the electronic control unit. The electronic control unit drives the telescopic member to elongate and shorten. The flexible light guiding sheet is connected to the telescopic member. When the electronic control unit drives the telescopic member to elongate, the flexible light guiding sheet protrudes onto the substrate via the through groove of the substrate and deflects toward a specific direction, changing the illumination direction of the light source.

The telescopic member comprises a piezoelectric material.

The flexible light guiding sheet comprises an opaque reflective sheet or a refractive sheet pervious to light.

The substrate further comprises a guiding tube portion corresponding to the through groove. The flexible light guiding sheet is received in the guiding tube portion and protrudes from the guiding tube portion onto the substrate via the through groove.

A part of the electronic control unit extends to the exterior of the base.

The light source is electrically connected to the electronic control unit.

The lamp further comprises a lampshade connected to the base and covering the substrate and light source.

Another exemplary embodiment of the invention provides a lamp with functions of adjusting illumination directions, comprising a base, a substrate, a first light source, a second light source, an electronic control unit, a telescopic member, a first flexible light guiding sheet, and a second flexible light guiding sheet. The substrate is disposed on the base and comprises a through groove. The first light source is disposed on the substrate. The second light source is disposed on the substrate. The electronic control unit is disposed in the base. The telescopic member is disposed in the base and is connected to the electronic control unit. The electronic control unit drives the telescopic member to elongate and shorten. The first flexible light guiding sheet is connected to the telescopic member. The second flexible light guiding sheet is connected to the telescopic member. When the electronic control unit drives the telescopic member to elongate, the first and second flexible light guiding sheets protrude onto the substrate via the through groove of the substrate and respectively deflect toward a first direction and a second direction, changing the illumination directions of the first and second light sources.

The telescopic member comprises a piezoelectric material.

The first flexible light guiding sheet comprises an opaque reflective sheet or a refractive sheet pervious to light.

The second flexible light guiding sheet comprises an opaque reflective sheet or a refractive sheet pervious to light.

The substrate further comprises a guiding tube portion corresponding to the through groove. The first and second flexible light guiding sheets are received in the guiding tube portion and protrude from the guiding tube portion onto the substrate via the through groove.

A part of the electronic control unit extends to the exterior of the base.

The first and second light sources are electrically connected to the electronic control unit.

The lamp further comprises a lampshade connected to the base and covering the substrate, first light source, and second light source.

The lamp further comprises a gripper connected between the telescopic member, first flexible light guiding sheet, and second flexible light guiding sheet. The gripper is selectively opened and closed to change deflection of the first and second flexible light guiding sheets.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

In the following detailed description of the preferred embodiments, reference is made to the accompanying drawings which form a part hereof, and in which are shown by way of illustration specific embodiments in which the invention may be practiced. In this regard, directional terminology, such as "top," "bottom." "front," "back," etc., is used with reference to the orientation of the Figure(s) being described. The components of the present invention can be positioned in a number of different orientations. As such, the directional terminology is used for purposes of illustration and is in no way limiting. On the other hand, the drawings are only schematic and the sizes of components may be exaggerated for clarity. It is to be understood that other embodiments may be utilized and structural changes may be made without departing from the scope of the present invention. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted" and variations thereof herein are used broadly and encompass direct and indirect connections, couplings, and mountings. Similarly, the terms "facing," "faces" and variations thereof herein are used broadly and encompass direct and indirect facing, and "adjacent to" and variations thereof herein are used broadly and encompass directly and indirectly "adjacent to". Therefore, the description of "A" component facing "B" component herein may contain the situations that "A" component directly faces "B" component directly or one or more additional components are between "A" component and "B" component. Also, the description of "A" component "adjacent to" "B" component herein may contain the situations that "A" component is directly "adjacent to" "B" component or one or more additional components are between "A" component and "B" component. Accordingly, the drawings and descriptions will be regarded as illustrative in nature and not as restrictive.

First Embodiment

Figure 1A:
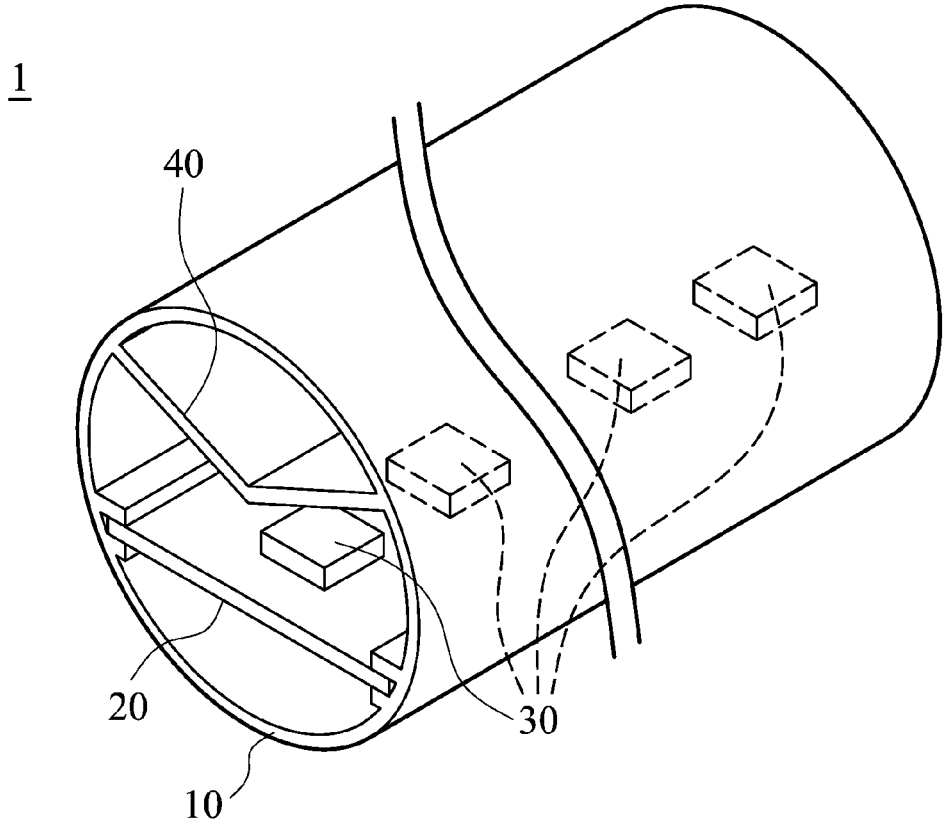
FIG. 1A ( PRIOR ART )
FIG. 1A is a schematic perspective view of a conventional lamp.
Figure 1B:
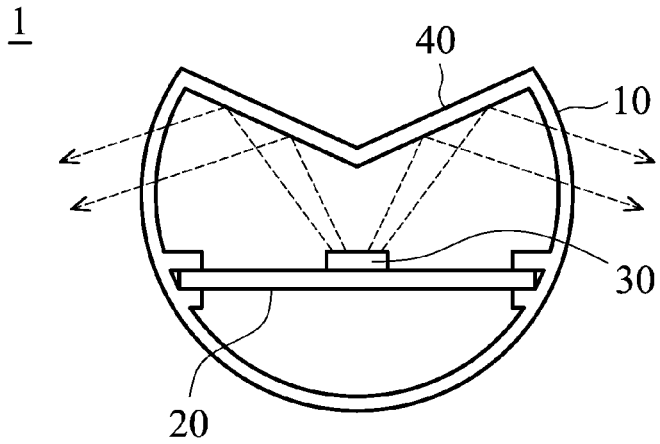
FIG. 1B ( PRIOR ART )
FIG. 1B is a schematic front view of the conventional lamp.
Figure 2A:
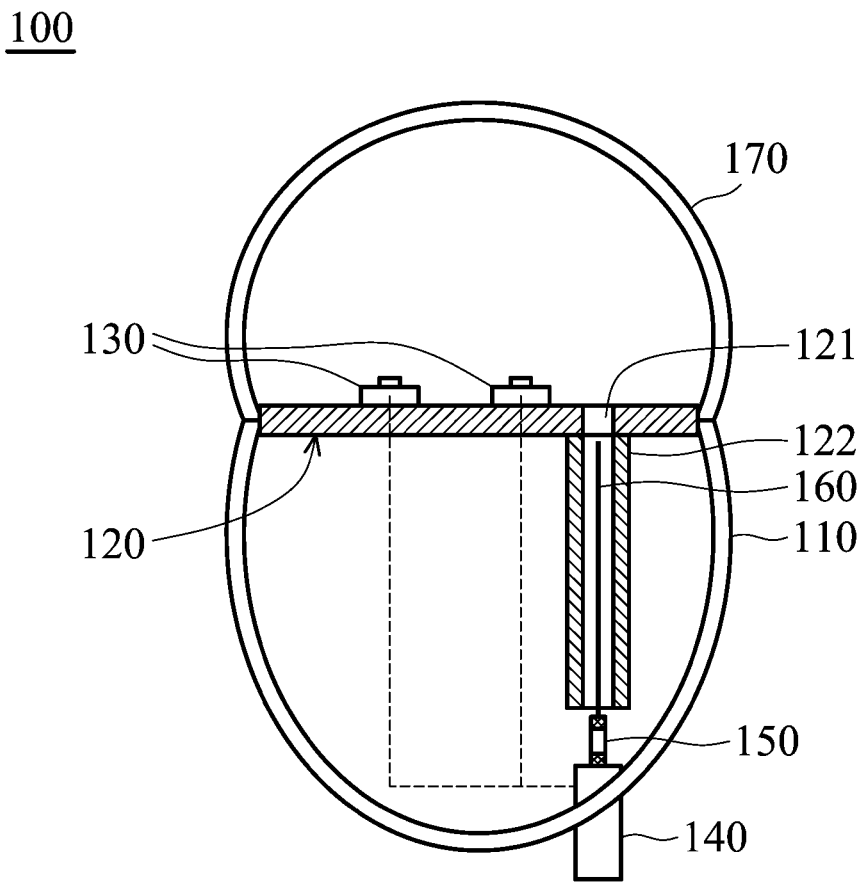
FIG. 2A is a schematic view of a lamp of a first embodiment of the invention in an operational mode.
Figure 2B:
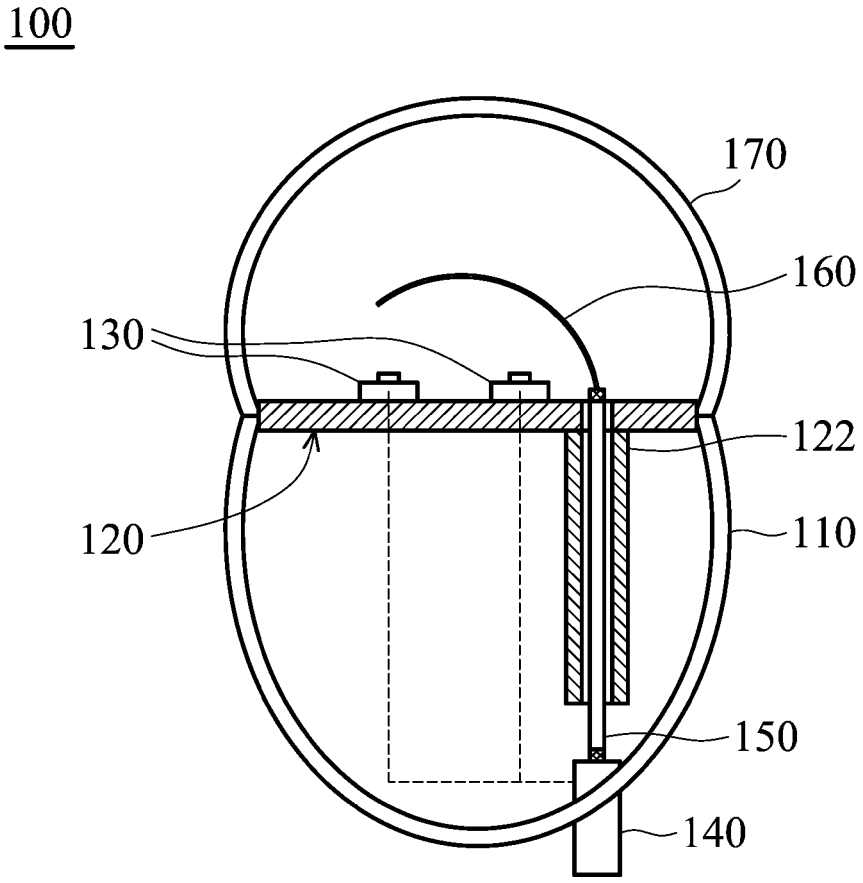
FIG. 2B is a schematic view of the lamp of the first embodiment of the invention in another operational mode.

Referring to FIG. 2A and FIG. 2B, a lamp 100 with functions of adjusting an illumination direction comprises a base 110, a substrate 120, a plurality of light sources 130, an electronic control unit 140, a telescopic member 150, a flexible light guiding sheet 160, and a lampshade 170.

The substrate 120 is disposed on the base 110 and comprises a through groove 121 and a guiding tube portion 122 corresponding to the through groove 121.

The light sources 130 are disposed on the substrate 120 and are electrically connected to the electronic control unit 140. Moreover, in this embodiment, the light sources 130 may be light-emitting diodes.

The electronic control unit 140 is disposed in the base 110. Here, a part of the electronic control unit 140 extends to the exterior of the base 110, facilitating operation thereof.

The telescopic member 150 is disposed in the base 110 and is connected to the electronic control unit 140. Here, the electronic control unit 140 can drive the telescopic member 150 to elongate or shorten. For example, when the telescopic member 150 is composed of a piezoelectric material, a voltage change provided by the electronic control unit 140 can drive the telescopic member 150 to elongate or shorten.

The flexible light guiding sheet 160 is connected to the telescopic member 150. Here, the flexible light guiding sheet 160 is received in the guiding tube portion 122 of the substrate 120 and protrudes from the guiding tube portion 122 onto the substrate 120 via the through groove 121. In this embodiment, the flexible light guiding sheet 160 may be an opaque reflective sheet or a refractive sheet pervious to light. Moreover, the flexible light guiding sheet 160 may be coated with fluorescent particles assisting in illumination.

The lampshade 170 is connected to the base 110 and covers the substrate 120 and light sources 130.

Accordingly, when the telescopic member 150 is not operated by the electronic control unit 140, the flexible light guiding sheet 160 is received in the guiding tube portion 122 of the substrate 120, as shown in FIG. 2A. At this point, light from the light sources 130 can be directly transmitted to the exterior of the lamp 100 through the lampshade 170.

In another aspect, when the electronic control unit 140 drives the telescopic member 150 to elongate, as shown in FIG. 2B, the flexible light guiding sheet 160 connected to the telescopic member 150 protrudes onto the substrate 120 via the through groove 121 of the substrate 120 and deflects toward a specific direction (e.g. the leftward direction in FIG. 2B). At this point, the flexible light guiding sheet 160 can change the illumination direction of the light sources 130. Specifically, by controlling the voltage change using the electronic control unit 140, elongation and shortening operations of the telescopic member 150 can be arbitrarily performed, enabling the length by which the flexible light guiding sheet 160 protrudes onto the substrate 120 and the deflection of the flexible light guiding sheet 160 to be arbitrarily controlled, and further achieving an effect of arbitrarily adjusting the illumination direction or angle.

Second Embodiment

Elements corresponding to those in the first embodiment share the same reference numerals.

Figure 3A:
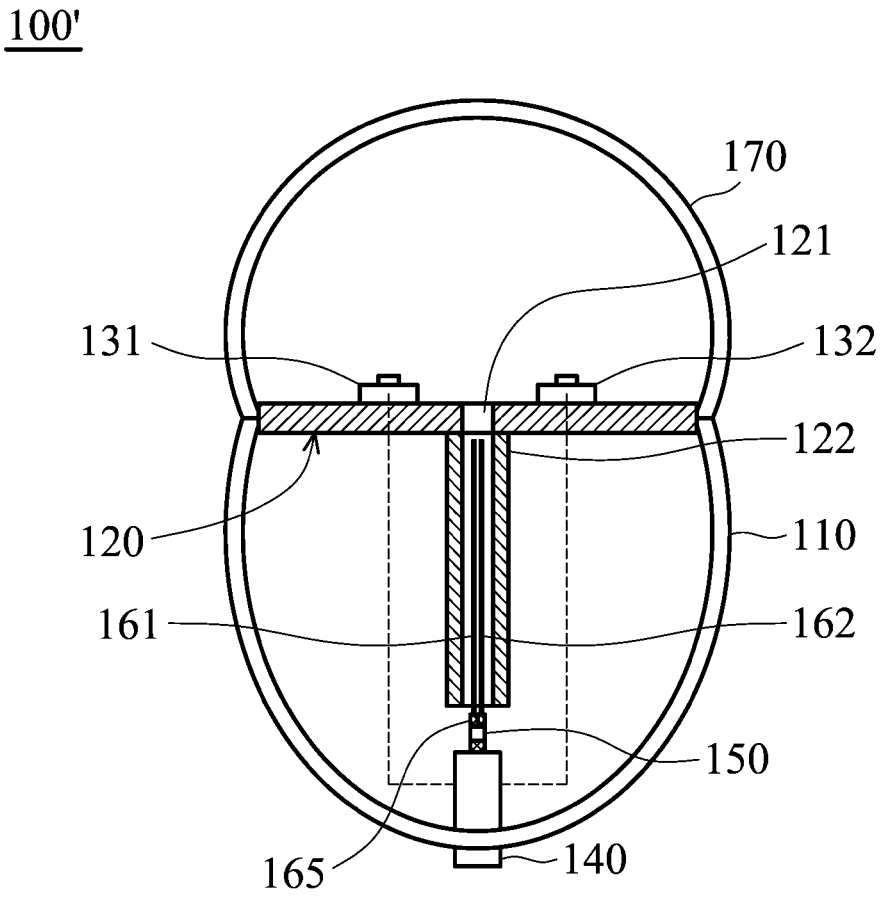
FIG. 3A is a schematic view of a lamp of a second embodiment of the invention in an operational mode.
Figure 3B:
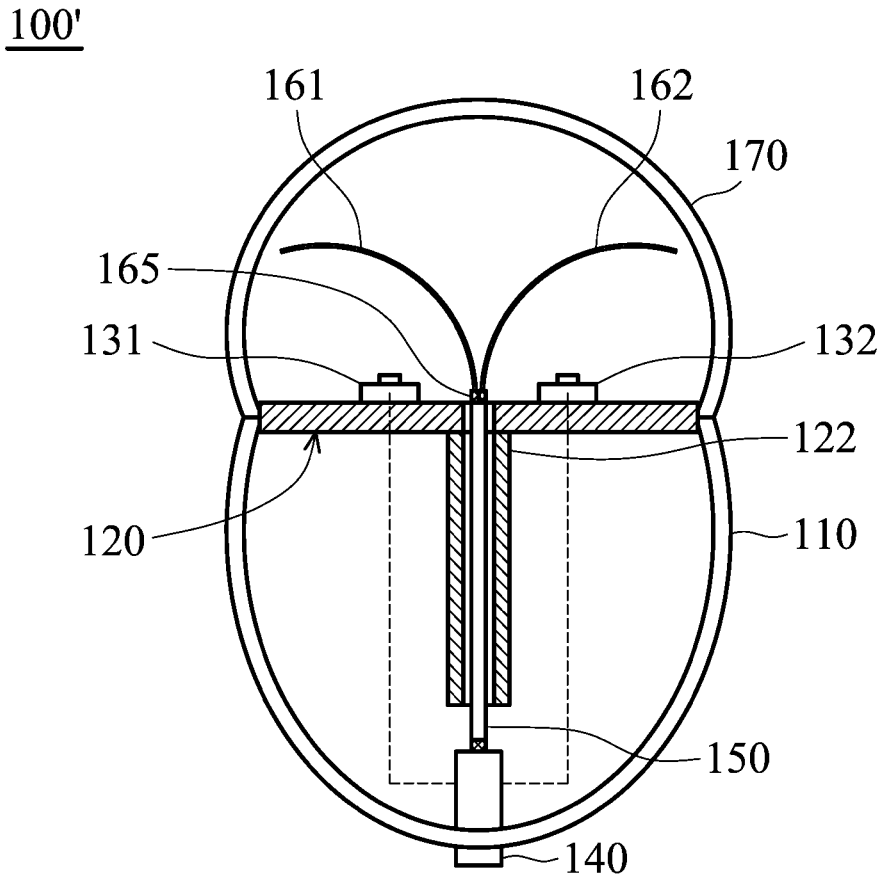
FIG. 3B is a schematic view of the lamp of the second embodiment of the invention in another operational mode.
Figure 3C:
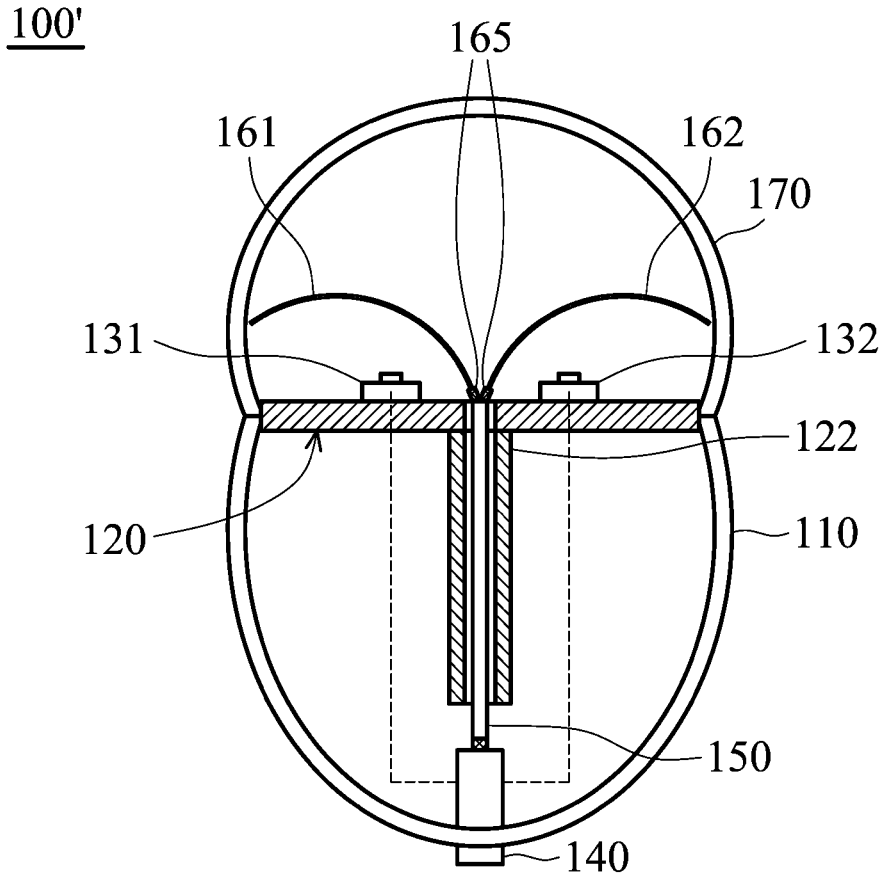
FIG. 3C is a schematic view of the lamp of the second embodiment of the invention in yet another operational mode.

Referring to FIGS. 3A, 3B, and 3C, a lamp 100' with functions of adjusting illumination directions comprises a base 110, a substrate 120, a first light source 131, a second light source 132, an electronic control unit 140, a telescopic member 150, a first flexible light guiding sheet 161, a second flexible light guiding sheet 162, a gripper 165, and a lampshade 170.

As shown in FIG. 3A, the substrate 120 is disposed on the base 110 and comprises a through groove 121 and a guiding tube portion 122 corresponding to the through groove 121.

As shown in FIGS. 3A, 3B, and 3C, the first light source 131 and second light source 132 are disposed on the substrate 120 and are electrically connected to the electronic control unit 140. In this embodiment, the first light source 131 and second light source 132 may be light-emitting diodes.

The electronic control unit 140 is disposed in the base 110. Similarly, a part of the electronic control unit 140 extends to the exterior of the base 110, facilitating operation thereof.

The telescopic member 150 is disposed in the base 110 and is connected to the electronic control unit 140. Here, the electronic control unit 140 can drive the telescopic member 150 to elongate or shorten. Similarly, when the telescopic member 150 is composed of a piezoelectric material, a voltage change provided by the electronic control unit 140 can drive the telescopic member 150 to elongate or shorten.

The first flexible light guiding sheet 161 and second flexible light guiding sheet 162 are connected to the telescopic member 150 through the gripper 165. Namely, the gripper 165 is connected between the telescopic member 150, first flexible light guiding sheet 161, and second flexible light guiding sheet 162. Here, the first flexible light guiding sheet 161 and second flexible light guiding sheet 162 are received in the guiding tube portion 122 of the substrate 120 and protrude from the guiding tube portion 122 onto the substrate 120 via the through groove 121. In this embodiment, each of the first flexible light guiding sheet 161 and second flexible light guiding sheet 162 may be an opaque reflective sheet or a refractive sheet pervious to light. Moreover, the first flexible light guiding sheet 161 and second flexible light guiding sheet 162 may be coated with fluorescent particles assisting in illumination. Additionally, the gripper 165 may be electrically connected to the electronic control unit 140.

The lampshade 170 is connected to the base 110 and covers the substrate 120, first light source 131, and second light source 132.

Accordingly, when the telescopic member 150 is not operated by the electronic control unit 140, the first flexible light guiding sheet 161 and second flexible light guiding sheet 162 are simultaneously received in the guiding tube portion 122 of the substrate 120, as shown in FIG. 3A. At this point, light from the first light source 131 and second light source 132 can be directly transmitted to the exterior of the lamp 100' through the lampshade 170.

In another aspect, when the electronic control unit 140 drives the telescopic member 150 to elongate, as shown in FIG. 3B, the first flexible light guiding sheet 161 and second flexible light guiding sheet 162 connected to the telescopic member 150 protrude onto the substrate 120 via the through groove 121 of the substrate 120 and respectively deflect toward a first direction and a second direction (e.g. the leftward and rightward directions in FIG. 3B). At this point, the first flexible light guiding sheet 161 and second flexible light guiding sheet 162 can change the illumination directions of the first light source 131 and second light source 132, respectively. Similarly, by controlling the voltage change using the electronic control unit 140, elongation and shortening operations of the telescopic member 150 can be arbitrarily performed, enabling the length by which the first flexible light guiding sheet 161 and second flexible light guiding sheet 162 protrude onto the substrate 120 and the deflection of the first flexible light guiding sheet 161 and second flexible light guiding sheet 162 to be arbitrarily controlled, and further achieving an effect of arbitrarily adjusting the illumination directions or angles.

In addition to the aforementioned adjustment of the illumination directions, the gripper 165 electrically connected to the electronic control unit 140 may be selectively opened and closed to further change the deflection of the first flexible light guiding sheet 161 and second flexible light guiding sheet 162, as shown in FIG. 3C. At this point, the further deflected first flexible light guiding sheet 161 and second flexible light guiding sheet 162 can further change the illumination directions of the first light source 131 and second light source 132, respectively.

In conclusion, in the disclosed lamps, the illumination directions of the light sources can be arbitrarily adjusted by simplified mechanisms. Thus, the disclosed lamps are provided with enhanced industrial applicability.

The foregoing description of the preferred embodiments of the invention has been presented for purposes of illustration and description. It is not intended to be exhaustive or to limit the invention to the precise form or to exemplary embodiments disclosed. Accordingly, the foregoing description should be regarded as illustrative rather than restrictive. Obviously, many modifications and variations will be apparent to practitioners skilled in this art. The embodiments are chosen and described in order to best explain the principles of the invention and its best mode practical application, thereby to enable persons skilled in the art to understand the invention for various embodiments and with various modifications as are suited to the particular use or implementation contemplated. It is intended that the scope of the invention be defined by the claims appended hereto and their equivalents in which all terms are meant in their broadest reasonable sense unless otherwise indicated. Therefore, the term "the invention", "the present invention" or the like does not necessarily limit the claim scope to a specific embodiment, and the reference to particularly preferred exemplary embodiments of the invention does not imply a limitation on the invention, and no such limitation is to be inferred. The invention is limited only by the spirit and scope of the appended claims. The abstract of the disclosure is provided to comply with the rules requiring an abstract, which will allow a searcher to quickly ascertain the subject matter of the technical disclosure of any patent issued from this disclosure. It is submitted with the understanding that it will not be used to interpret or limit the scope or meaning of the claims. Any advantages and benefits described may not apply to all embodiments of the invention. It should be appreciated that variations may be made in the embodiments described by persons skilled in the art without departing from the scope of the present invention as defined by the following claims. Moreover, no element and component in the present disclosure is intended to be dedicated to the public regardless of whether the element or component is explicitly recited in the following claims.

What is claimed is:

1. A lamp with functions of adjusting an illumination direction, comprising:

a base having an inner wall;

a substrate disposed on the base and comprising a through groove, wherein a first side of the substrate and the inner wall of the base define a space;

at least one light source disposed on the substrate;

an electronic control unit disposed in the base, wherein at least a portion of the electronic control unit is accommodated in the space;

a telescopic member disposed in the base, accommodated in the space, and connected to the electronic control unit, wherein the electronic control unit is configured to drive the telescopic member to elongate and shorten; and a flexible light guiding sheet connected to the telescopic member and accommodated entirely in the space when the telescopic member is shortened, arranged such that when the electronic control unit drives the telescopic member to elongate, the flexible light guiding sheet protrudes from the space via the through groove over a second side of the substrate opposite to the first side and deflects toward a specific direction, changing the illumination direction of the light source.

2. The lamp as claimed in claim 1, wherein the telescopic member comprises a piezoelectric material.

3. The lamp as claimed in claim 1, wherein the flexible light guiding sheet comprises an opaque reflective sheet or a refractive sheet pervious to light.

4. The lamp as claimed in claim 1, wherein the substrate further comprises a guiding tube portion accommodated in the space and corresponding to the through groove, and the flexible light guiding sheet is received in the guiding tube portion and protrudes from the guiding tube portion onto the substrate via the through groove.

5. The lamp as claimed in claim 1, wherein a part of the electronic control unit extends to the exterior of the base.

6. The lamp as claimed in claim 1, wherein the light source is electrically connected to the electronic control unit.

7. The lamp as claimed in claim 1, further comprising a lampshade connected to the base and covering the second side of the substrate and the light source.

8. A lamp with functions of adjusting illumination directions, comprising:

a base having an inner wall;

a substrate disposed on the base, wherein a first side of the substrate and the inner wall of the base define a space, and comprising a through groove;

a first light source disposed on the substrate;

a second light source disposed on the substrate;

an electronic control unit disposed in the base, wherein at least a portion of the electronic control unit is accommodated in the space;

a telescopic member disposed in the base, accommodated in the space, and connected to the electronic control unit, wherein the electronic control unit is configured to drive the telescopic member to elongate and shorten;

a first flexible light guiding sheet connected to the telescopic member and accommodated entirely in the space when the telescopic member is shortened; and a second flexible light guiding sheet connected to the telescopic member and accommodated entirely in the space when the telescopic member is shortened, arranged such that when the electronic control unit drives the telescopic member to elongate, the first and second flexible light guiding sheets protrude from the space via the through groove over a second side of the substrate opposite to the first side and respectively deflect toward a first direction and a second direction, changing the illumination directions of the first and second light sources.

9. The lamp as claimed in claim 8, wherein the telescopic member comprises a piezoelectric material.

10. The lamp as claimed in claim 8, wherein the first flexible light guiding sheet comprises an opaque reflective sheet or a refractive sheet pervious to light.

11. The lamp as claimed in claim 8, wherein the second flexible light guiding sheet comprises an opaque reflective sheet or a refractive sheet pervious to light.

12. The lamp as claimed in claim 8, wherein the substrate further comprises a guiding tube portion accommodated in the space and corresponding to the through groove, and the first and second flexible light guiding sheets are received in the guiding tube portion and protrude from the guiding tube portion onto the substrate via the through groove.

13. The lamp as claimed in claim 8, wherein a part of the electronic control unit extends to the exterior of the base.

14. The lamp as claimed in claim 8, wherein the first and second light sources are electrically connected to the electronic control unit.

15. The lamp as claimed in claim 8, further comprising a lampshade connected to the base and covering the second side of the substrate, the first light source, and the second light source.

16. The lamp as claimed in claim 8, further comprising a gripper connected between the telescopic member, first flexible light guiding sheet, and second flexible light guiding sheet, wherein the gripper is selectively opened and closed to change deflection of the first and second flexible light guiding sheets.

17. The lamp as claimed in claim 1, wherein the light source is disposed on the second side of the substrate.

18. The lamp as claimed in claim 8, wherein the first and second light sources are disposed on the second side of the substrate.

* * * * *